US008408886B2

(12) United States Patent
Fabbri

(10) Patent No.: US 8,408,886 B2
(45) Date of Patent: Apr. 2, 2013

(54) HIGH PRESSURE PLUNGER PUMP

(75) Inventor: Fabrizio Fabbri, Modena (IT)

(73) Assignee: Annovi Reverberi S.p.A., Modena (IT)

( * ) Notice: Subject to any disclaimer, the term of this patent is extended or adjusted under 35 U.S.C. 154(b) by 1925 days.

(21) Appl. No.: 10/777,627

(22) Filed: Feb. 13, 2004

(65) Prior Publication Data

US 2004/0161353 A1 Aug. 19, 2004

(30) Foreign Application Priority Data

Feb. 19, 2003 (IT) ..... RE2003A0019

(51) Int. Cl.
*F04B 39/00* (2006.01)
*F04B 53/00* (2006.01)
*F04B 39/10* (2006.01)

(52) U.S. Cl. ..... 417/454; 417/569; 417/571

(58) Field of Classification Search ..... 417/569, 417/269, 570, 571, 364, 454, 490, 222.2
See application file for complete search history.

(56) References Cited

U.S. PATENT DOCUMENTS 3,306,214 A * 2/1967 Hagler ..... 417/307
3,372,648 A * 3/1968 Hammelmann ..... 417/567
3,373,695 A 3/1968 Yohpe
3,427,988 A * 2/1969 Schmieman et al. ..... 417/569
3,849,032 A * 11/1974 Mulvey et al. ..... 417/454
4,239,463 A * 12/1980 Yaindl ..... 417/454
4,456,439 A * 6/1984 Wolff ..... 417/454
4,618,316 A * 10/1986 Elliott ..... 417/454
4,716,924 A 1/1988 Pacht
4,768,933 A * 9/1988 Stachowiak ..... 417/570
4,788,933 A 12/1988 Stachowiak
5,171,136 A * 12/1992 Pacht ..... 417/571
5,253,987 A * 10/1993 Harrison ..... 417/566
6,332,761 B1 12/2001 Guentert et al.

FOREIGN PATENT DOCUMENTS

EP 0908627 4/1999

* cited by examiner

*Primary Examiner* — Peter J Bertheaud
(74) *Attorney, Agent, or Firm* — Browdy and Neimark, PLLC

(57) ABSTRACT

High pressure plunger pump, comprising at least two in-line cylinders as seat for respective plungers, where each cylinder is connected via respective conduits and relative valves to an intake manifold and to a delivery manifold, the cylinders are provided within a single block together with the conduits and the manifold; the intake manifold is positioned in front of the line of cylinders and is in direct communication with the cylinders via a conduit connected to a dead compartment provided as an extension of the respective cylinder and in which the intake valve is located; the intake valve is retained in position by the actual valve seat sealing gaskets or by an elastic plate.

12 Claims, 3 Drawing Sheets

FIG.3
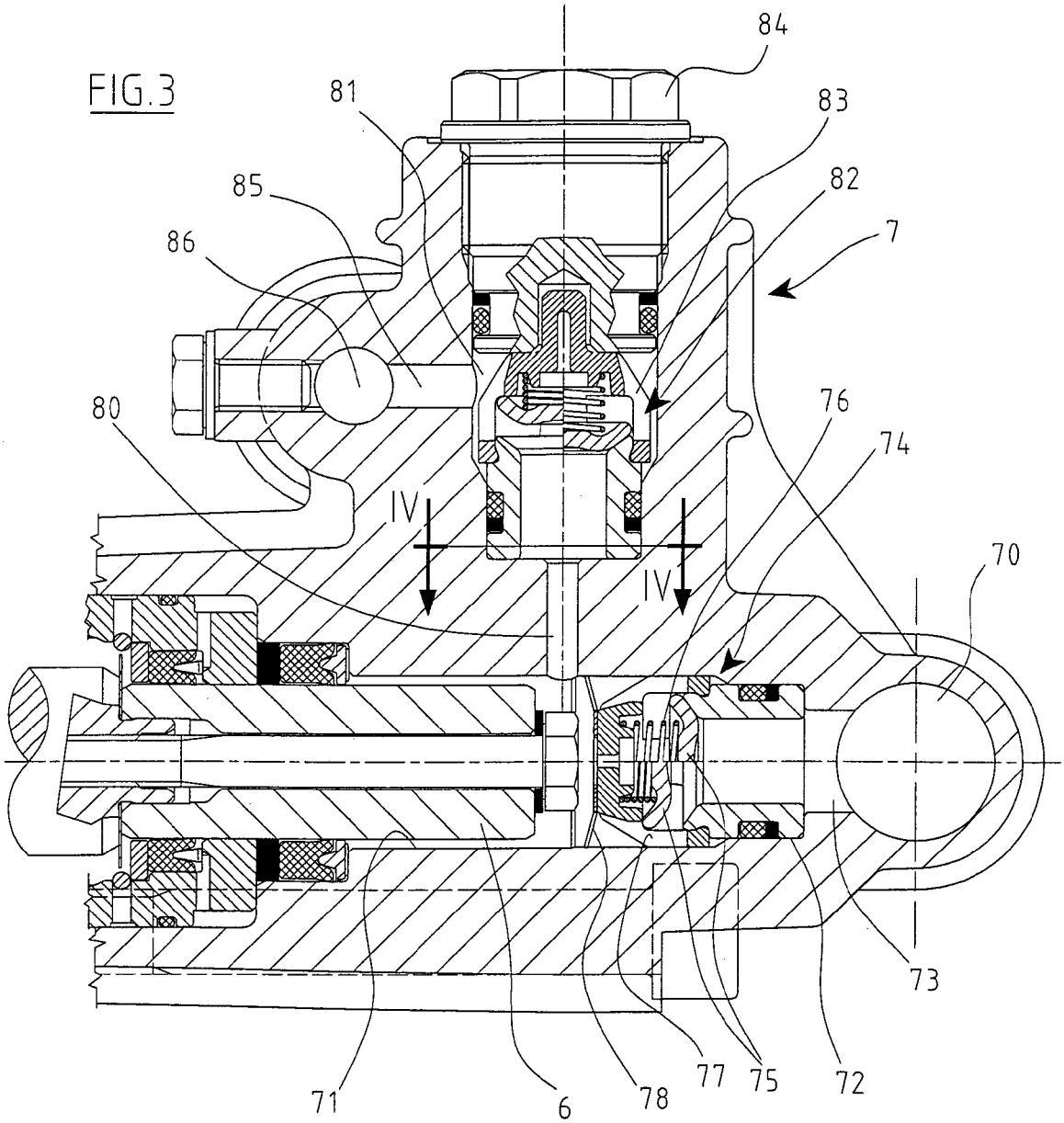
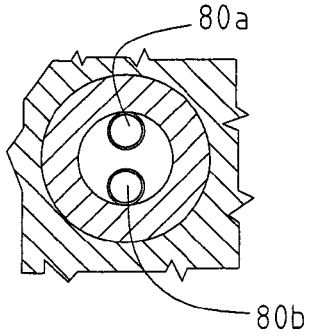
FIG.4
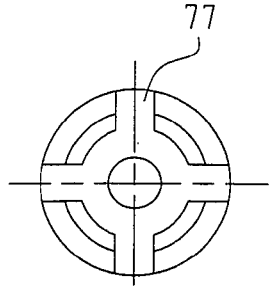
FIG.5

HIGH PRESSURE PLUNGER PUMP

FIELD OF THE INVENTION

The present invention relates to single or multi-cylinder high pressure pumps used in particular in the industrial wash sector.

Said pumps have high performance in terms of pressure, whereas they present a relatively modest capacity.

So-called plunger pumps are known in which the cylinders are in line, the intake and delivery manifolds being located respectively on one and the other side of the plane comprising the cylinder axes.

The cylinders, the manifolds and the relative conduits are provided within a single block generally of brass.

The cylinders are generally of horizontal axis, the manifolds being positioned above and respectively below the line of cylinders.

From the end of the head of each cylinder, forming the compression chamber for the pumped fluid, there branch two opposing aligned conduits which open into the compartment containing the intake valve and delivery valve, this compartment being in communication with the respective manifolds.

The compartments containing the valves communicate with the outside and are closed by a plug which also maintains the valve in position.

The holes which connect each pumping chamber to the respective valve containing compartments are formed by a single boring operation by means of a tool which enters the compartment containing the delivery valve.

It follows that in current constructions, the intake conduit has a diameter which cannot exceed the diameter of the delivery conduit.

The valves are pre-mounted in cages which are inserted into the respective compartment from the outside.

The aforesaid construction presents two problems.

A first problem is the constructional complication which for each cylinder requires the formation of two valve containing compartments communicating with the outside, and the provision of the relative sealed plugs.

The second problem arises when the pump exceeds a determined operation pressure.

In this respect it has been found that that region around the delivery and intake conduit connections in the cylinder head (pumping chamber) is subjected to repeated high fatigue stresses which for pressures exceeding 300 bar quickly result in cracks and the triggering of fractures.

This drawback can be partly remedied by reducing the diameter of the delivery conduit, but this can be done only to a very small extent because the intake conduit is also reduced at the same time, with consequent appearance of cavitation phenomena.

It follows that for very high pressures, of the indicated order, the pumps cannot be constructed of brass, but instead stainless steel has to be used.

As steel is much more difficult to machine than brass, there is a considerable cost increase.

SUMMARY OF THE INVENTION

The object of the present invention is to overcome the aforesaid drawbacks within the framework of a simple and economical solution.

Said object is attained, according to the invention, by forming the compartment containing the intake valve as an extension of the respective cylinder, and communicating with an intake manifold positioned in front of the cylinder head.

Preferably the compartment is cylindrical and coaxial with the respective cylinder, the intake manifold presenting its axis coplanar with the cylinder axes.

In this manner the intake conduit is virtually eliminated, the construction of the delivery conduit being independent of the construction of the intake conduit.

The delivery conduit can consequently be comparatively very small, and two smaller parallel delivery conduits could be provided of total cross-section equal to that of the single conduit.

By this means, the area surrounding the connection between the delivery conduit or conduits and the cylinder head is made much more robust, with the result that the stated problems are overcome.

The merits and the constructional and operational characteristics of the invention will be apparent from the ensuing detailed description with reference to the accompanying drawings, which illustrate a preferred embodiment thereof given by way of non-limiting example.

BRIEF DESCRIPTION OF THE DRAWINGS

FIG. 3 shows an enlarged portion of FIG. 2.

FIG. 4 shows the section IV-IV of FIG. 3.

FIG. 5 shows a detail of the pump.

DESCRIPTION OF THE PREFERRED EMBODIMENT

Figure 1:
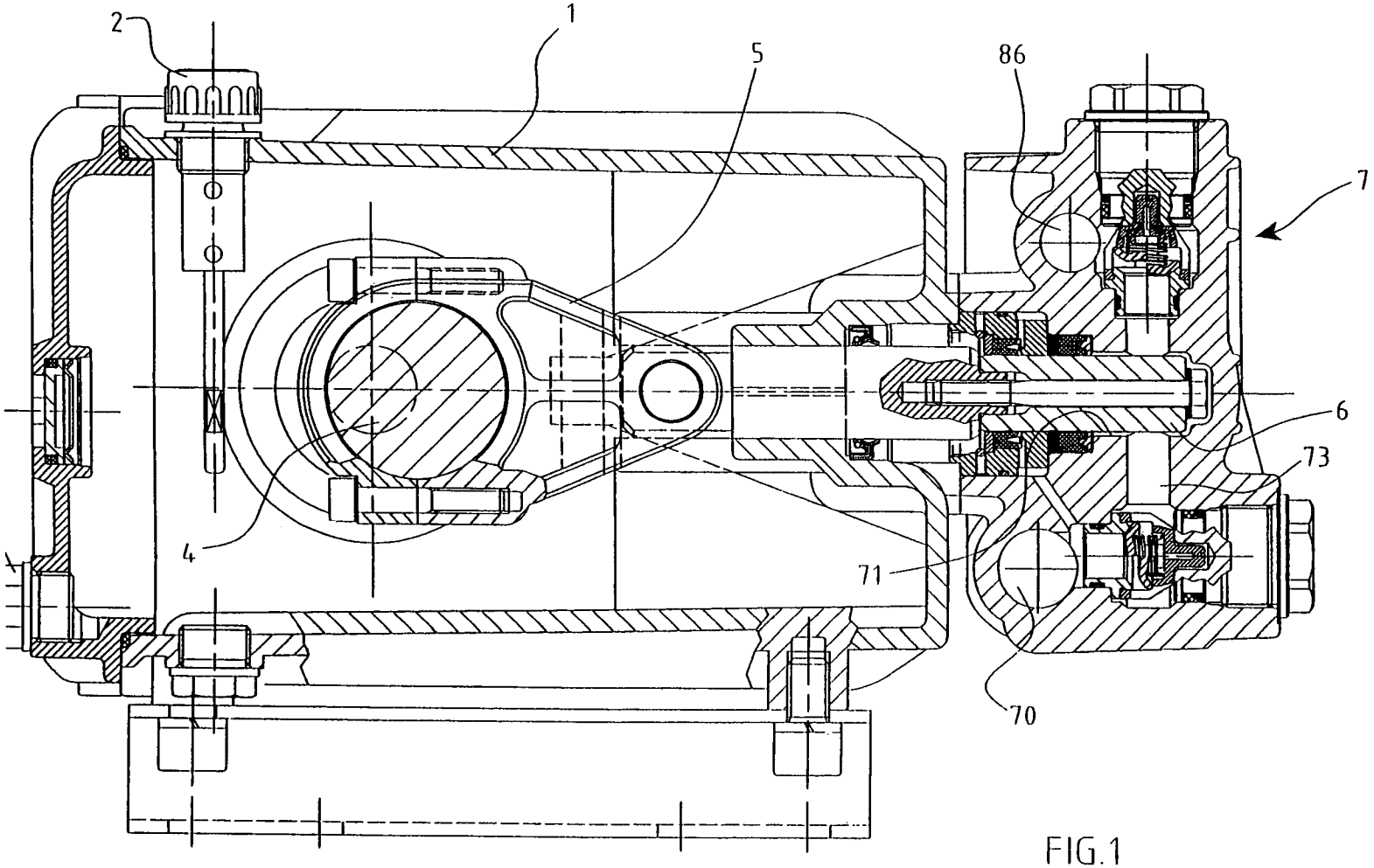
FIG. 1 PRIOR ART
FIG. 1 is a section through a pump of the known art.
Figure 2:
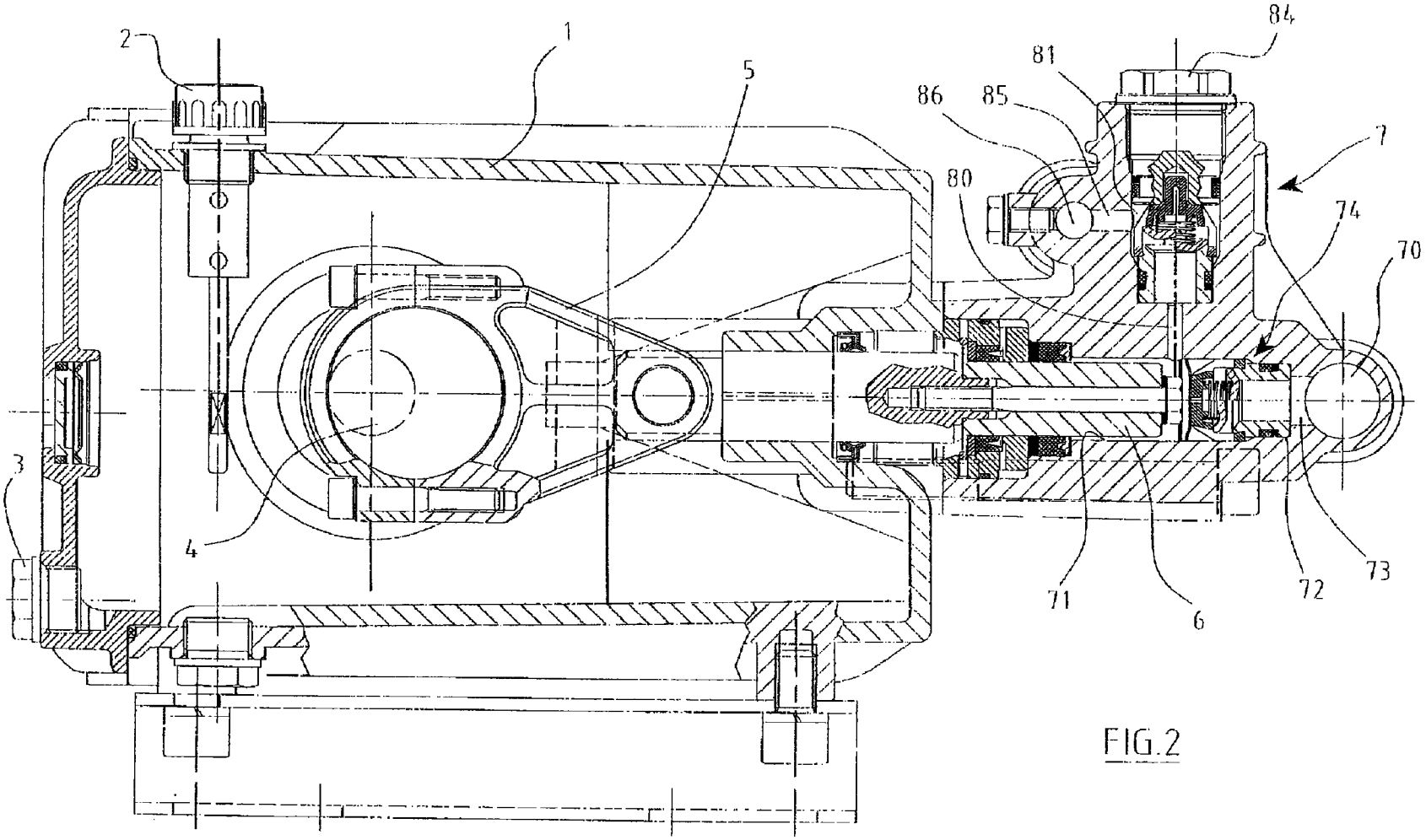
FIG. 2 shows the same pump modified in accordance with the invention.

FIGS. 2 to 5 show a pump having several cylinders in line.

The pump comprises a casing 1 provided with a filling and checking plug 2 for the lubricating oil, and a plug 3 for its discharge.

Within the casing 1 a crankshaft 4 is supported by usual rolling-contact bearings, to operate by means of the crank arms 5 the plungers 6 which are each inserted into a cylinder 71 provided within the head 7.

Each cylinder 71 extends into a compartment 72 coaxial therewith to receive the intake valve 74; the compartment 72 communicates via the intake conduit 73 with the intake manifold 70, the axis of which is coplanar with the cylinder axes.

The intake valve 74 comprises a disc 75 maintained in position by the spring 76; the entire assembly is contained in a known cage 77 which maintains the disc sealing seat in position in accordance with a known construction.

The valve is mounted though the cylinder 71, before inserting the plunger 6 therein.

The cage 77 is maintained in position by a cross-shaped elastic plate 78 inserted in the immediate vicinity of the cage (FIG. 5).

The delivery conduit 80 extends from the side wall of the cylinder 71, to open into the externally open compartment 81 containing the delivery valve 82 which is contained in a cage 83 similar to the cage 77.

The compartment 81 is hermetically sealed by the plug 84, through the seat of which the cage 83 is inserted and retained in position by the plug.

The valve compartment communicates with the delivery manifold 86 via a conduit 85.

It should be noted that the diameters of the conduits 80 and of the manifold 86 are much smaller comparatively than the typical diameters of the known art, with consequent increase in thicknesses and a strengthening of the entire structure.

In an alternative embodiment two delivery conduits 80*a* and 80*b* can be provided, shown in FIG. 4, which for an equal overall cross-section offer an even greater strengthening of the structure.

The description of the seal gaskets is omitted, these being clear from the drawing and being entirely usual.

The number of cylinders is unimportant.

FIG. 1 shows a pump of the known art, in which the same reference numerals are used as in FIGS. 2 to 5, to facilitate comparison.

What is claimed is:

1. A high pressure plunger pump comprising at least two in-line cylinders, each cylinder being provided with a plunger, and being connected via a conduit and an intake valve, as part of a valve assembly, to an intake manifold and to a delivery manifold, said cylinders being provided within a single block formed as a unit together with the seats of the intake valves, of delivery valves and with said conduits and with said manifolds, wherein the intake manifold is positioned in front of the line of cylinders and is in direct communication with the cylinders via a conduit connected to a dead compartment provided as an extension of the respective cylinder, and in which the intake valve is located, the intake valve assembly being retained in position by a deformable element, said pump having a delivery conduit with diameter smaller than the diameter of the cylinder.

2. A pump as claimed in claim 1, characterized in that the intake manifold has its axis coplanar with the cylinder axes.

3. A pump as claimed in claim 1, characterized in that the compartment containing the intake valve is cylindrical and coaxial with the respective cylinder.

4. A pump as claimed in claim 1, characterized in that each cylinder communicates with the compartment containing a delivery valve via two parallel conduits.

5. A pump as claimed in claim 1, characterized in that the deformable element are the actual valve seat sealing gaskets.

6. A pump as claimed in claim 1, characterized in that the deformable element is an elastic plate.

7. A high pressure plunger pump comprising at least two in-line cylinders, each cylinder being provided with a plunger, and being connected via a conduit and intake valve, as part of a valve assembly, to an intake manifold and to a delivery manifold, said cylinders being provided within a single block formed as a unit together with the seats of the intake valves, of delivery valves and with said conduits and with said manifolds, wherein the intake manifold is positioned in front of the line of cylinders and is in direct communication with the cylinders via a conduit connected to a dead compartment provided as an extension of the respective cylinder and in which the intake valve assembly is located, retained in position by a deformable element, wherein the intake manifold and the delivery manifold are connected to a respective at least one valve assembly by at least one respective delivery conduit having a diameter smaller than the diameter of the cylinder.

8. A pump as claimed in claim 7, characterized in that the intake manifold has its axis coplanar with the cylinder axes.

9. A pump as claimed in claim 7, characterized in that the compartment containing the intake valve is cylindrical and coaxial with the respective cylinder.

10. A pump as claimed in claim 7, characterized in that each cylinder communicates with the compartment containing a delivery valve via two parallel conduits.

11. A pump as claimed in claim 7, characterized in that the deformable element are the actual valve seat sealing gaskets.

12. A pump as claimed in claim 7, characterized in that the deformable element is an elastic plate.

* * * * *